US005113448A

United States Patent [19]

Nomura et al.

[11] Patent Number: 5,113,448

[45] Date of Patent: May 12, 1992

[54] SPEECH CODING/DECODING SYSTEM WITH REDUCED QUANTIZATION NOISE

[75] Inventors: Takahiro Nomura, Tokyo; Yohtaro Yatsuzuka, Kanagawa; Shigeru Iizuka, Saitama; Hideki Honma, Tokyo, all of Japan

[73] Assignee: Kokusai Denshin Denwa Co., Ltd., Tokyo, Japan

[21] Appl. No.: 463,280

[22] Filed: Dec. 15, 1989

[30] Foreign Application Priority Data

Dec. 22, 1988 [JP] Japan ..... 63-322167

[51] Int. Cl.[5] ..... G10L 5/00

[52] U.S. Cl. ..... 381/47; 381/30

[58] Field of Search ..... 381/29-47, 381/51-53; 369/513.5; 375/122

[56] References Cited

U.S. PATENT DOCUMENTS 4,757,517 7/1988 Yatsuzuka ..... 375/122
4,797,925 1/1989 Lin ..... 381/31
4,811,396 3/1989 Yatsuzura ..... 381/30

FOREIGN PATENT DOCUMENTS 2150377 6/1985 United Kingdom .

OTHER PUBLICATIONS

Ramamoorthy et al., "Enhancement of ADPCM Speech by Adaptive Postfiltering", AT&T Bell Lab. Tech. Jour., vol. 63, No. 8, Oct. 1984 pp. 1465-1475.
Adaptive Postfiltering of 16/kbs-ADPCM Speech, Jayant et al., IEEE ICASSP 86, pp. 829-832.
"Linear Predictive Coding of Speech: Review and Current Directions", Manfred R. Schroeder, IEEE Communications Magazine, Aug. 1985, vol. 23, No. 8, pp. 54-61.

*Primary Examiner*—Emanuel S. Kemeny
*Attorney, Agent, or Firm*—Armstrong, Nikaido, Marmelstein, Kobuvcik & Murray

[57] ABSTRACT

An input speech signal is encoded by an adaptive quantizer device (16). The adaptive quantizer device quantizes the predicted residual signal produced by removing correlations from the digital input signal by predictors devices (6, 10). A coefficient or weighting factor, called a leakage, at the predictor device (6) is adaptively adjusted by a leakage selector device (47) depending upon a prediction gain. The prediction gain indicates the accuracy of the prediction. The value of leakage is in the range between 0 and 1, depending upon whether the speech signal is voiced sound or unvoiced sound.

13 Claims, 6 Drawing Sheets

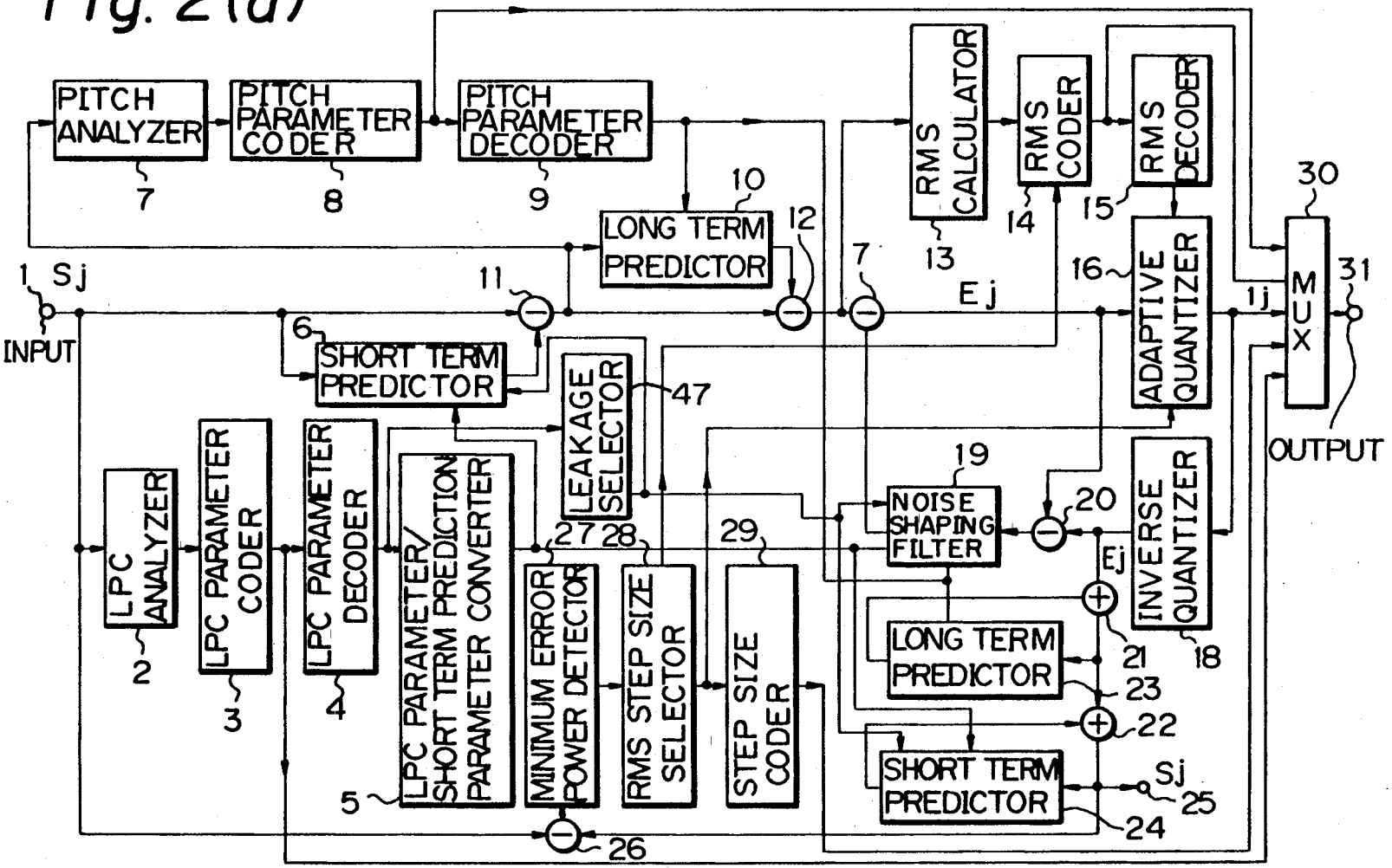
Fig. 2(a)
INPUT
1 Sj
PITCH ANALYZER
7
PITCH PARAMETER CODER
8
PITCH PARAMETER DECODER
9
LONG TERM PREDICTOR
10
RMS CALCULATOR
13
RMS CODER
14
RMS DECODER
15
ADAPTIVE QUANTIZER
16
Ej
7
12
11
SHORT TERM PREDICTOR
6
LPC ANALYZER
2
LPC PARAMETER CODER
3
LPC PARAMETER DECODER
4
LPC PARAMETER/ SHORT TERM PREDICTION PARAMETER CONVERTER
5
LEAKAGE SELECTOR
47
MINIMUM ERROR POWER DETECTOR
27
RMS STEP SIZE SELECTOR
28
STEP SIZE CODER
29
26
INVERSE QUANTIZER
18
20
NOISE SHAPING FILTER
19
Ej
21
LONG TERM PREDICTOR
23
22
SHORT TERM PREDICTOR
24
Sj
25
Ij
MUX
30
31
OUTPUT

SPEECH CODING/DECODING SYSTEM WITH REDUCED QUANTIZATION NOISE

BACKGROUND OF THE INVENTION

The present invention relates to a speech signal coding/decoding system for coding/decoding a digital input speech signal at a low bit rate.

In a system with a restricted frequency bandwidth and/or transmission power, such as a digital maritime satellite communication system or a digital business satellite communication system employing an SCPC (single channel per carrier), the speech coding/decoding system which can achieve a high speech quality at low bit rate and is hardly affected by a transmitted code error is required.

Based on such a background, a variety of speech coding/decoding systems have been already proposed. The typical systems thus proposed include an adaptive predictive coding (APC) system for coding an input signal, on a frame basis, with a predictor for removing a correlation from the input signal in order to obtain a residual signal. An adaptive quantizer quantizes the residual signal (U.S. Pat. No. 4,811,396, and U.S. Ser. No. 265,639). A multi-pulse excited linear predictive coding (MPEC) system excites an LPC synthetic filter by a plurality of pulses as a sound source. A CELP (code excited linear predictive coding) system excites an LPC synthetic filter by a residual signal pattern as the sound source, and the like.

The adaptive predictive coding (APC) system will be described below in detail as the typical example of a conventional speech coding/decoding system.

FIGS. 1(*a*) and 1(*b*) show the fundamental structure of a conventional adaptive predictive coding system (U.S. Ser. No. 265,639). In operation, a digital input signal is input to an LPC analyzer 2 and a short term predictor 6 via a coder input terminal 1. A short term spectral analysis (called "LPC analysis" hereinafter) is conducted on every frame by the LPC analyzer 2 based on the digital input signal. An LPC parameter obtained thereby is coded by an LPC parameter coder 3 to be transmitted to a decoder on a receiving side via a multiplexer 30. The output of the LPC parameter coder 3 is decoded by an LPC parameter decoder 4. A short term prediction parameter is obtained from the output of the decoder 4 by an LPC parameter/short term prediction parameter converter 5. The short term prediction parameter is input to a short term predictor 6, a noise shaping filter 19 and a local decoding short term predictor 24.

A correlation between the adjacent samples of a speech waveform is removed by subtracting the output of the short term predictor 6 employing the short term prediction parameter from the digital input signal by a subtracter 11 to obtain a short term prediction residual signal. This signal is input to a pitch analyzer 7 and a long term predictor 10. Pitch analysis is conducted on every frame by the pitch analyzer 7 based on the short term prediction residual signal. A pitch period and a pitch parameter obtained thereby are coded by a pitch parameter coder 8 to be transmitted to the decoder on the receiving side via the multiplexer 30. The pitch period and the pitch parameter are decoded by a pitch parameter decoder 9 to be set to a long term predictor 10, the noise shaping filter 19 and a local decoding long term predictor 23.

The periodicity of the short term predictor signal is removed by subtracting the output of the long term predictor 10 employing the pitch period and the pitch parameter from the short term prediction residual signal by a subtracter 12 to obtain a long term prediction residual signal which is ideally white noise. The output of the noise shaping filter 19 is subtracted from the long term prediction residual signal by a subtracter 17 to obtain a final prediction residual signal. This signal is quantized and coded by an adaptive quantizer 16 to be transmitted to the decoder on the receiving side via the multiplexer 30. The coded final predicted residual signal is decoded and inversely quantized by an inverse quantizer 18 to be input to a subtracter 20 and an adder 21. A quantization noise is obtained by subtracting the final predicted residual signal, an input signal to the adaptive quantizer 16, from the inversely quantized final predicted residual signal. The quantization noise is input to the noise shaping filter 19.

In order to update a step size of the adaptive quantizer for every subframe, an RMS (root mean square) value of the above-described long term predicted residual signal is calculated by an RMS value calculating circuit 13 to be coded as a reference level by an RMS value coder 14. The RMS value coder 14 stores a reference level and adjacent levels. The output signal of the RMS value coder 14 is decoded by an RMS value decoder 15 and a quantized RMS value corresponding to the reference level in particular is made as a reference RMS value. The step size of the adaptive quantizer 16 is determined by multiplying the reference RMS value by a fundamental step size prepared in advance. The output of the local decoding long term predictor 23 is added to a quantized final predicted residual signal, the output signal of the inverse quantizer 18, by the adder 21. An obtained resultant is input to the local decoding long term predictor 23 and added thereto with the output of the local decoding short term predictor 24 by an adder 22 and is input to the local decoding short term predictor 24. A locally decoded digital input signal is thereby obtained by this a procedure. A difference between the locally decoded digital input signal and the original digital input signal is obtained as an error signal by a subtracter 26. The power of the error signal is calculated by a minimum error power detector 27 over the sub-frames. A series of similar operations are performed with respect to other fundamental step sizes prepared in advance and the stored adjacent levels to the reference level. The coded RMS level and the fundamental step size that provide the minimum power in error signal powers thus obtained are selected to be transmitted to the decoder on the receiving side via the multiplexer 30. A step size coder 29 is used for coding the step size.

FIG. 1(*b*) is a block diagram showing the decoder used in a conventional adaptive predictive coding system.

Codes input via a decoder input terminal 32 are separated into signals relating to a final residual signal, the RMS value, the step size, the LPC parameter, the pitch period and the pitch parameter by a demultiplexer 33 to be and are input to an adaptive inverse quantizer 36, an RMS value decoder 35, a step size decoder 34, an LPC parameter decoder 38 and a pitch parameter decoder 37, respectively.

The RMS value decoded by the RMS value decoder 35 and the fundamental step size obtained by the step size decoder 34 are set to the adaptive inverse quantizer 36. A series of codes relating to the received final predicted residual signal is inversely quantized by the adaptive inverse quantizer 36 to obtain a quantized final predicted residual signal. A short term prediction parameter, decoded by the LPC parameter decoder 38 and obtained by an LPC parameter/short term prediction parameter converter 39, is input to the short term predictor 43, one of the predictors which form the synthetic filter, and to a post noise shaping filter 44. The pitch period and the pitch parameter, which are decoded by the pitch parameter decoder 37 are input to a long term predictor 42, the other predictor that forms the synthetic filter.

The output of the long term predictor 42 is added to the output of the adaptive inverse quantizer 36 by an adder 40. The output thereof is input to the long term predictor 42. The output of the adder 40 is added to the output of the short term predictor 43 by an adder 41 to obtain a reproduced speech signal. This signal is input to the short term predictor 43 and the post noise shaping filter 44 for noise-shaping. The reproduced speech signal is input also to a level adjuster 45 and the level is adjusted by comparing the reproduced speech signal with the output of the post noise shaping filter 44.

Specifically, a gain adjustment coefficient $G_0$ is obtained by;

$$G_0 = \frac{\text{RMS value of output of adder 41}}{\text{RMS value of output of post noise shaping filter 44}} \quad (1)$$

and the output of the post noise shaping filter 44 is multiplied by $G_0$.

The short term predictors 6, 24 and 43 in the coder and the decoder will be described below. The transfer function $P_s(z)$ of the short time predictors 6, 24 and 43 is given by;

$$P_s(z) = \sum_{i=1}^{N_s} a_i Z^{-i} \quad (2)$$

where $a_i$ is a short term prediction parameter and $N_s$ represents the number of taps of the short term predictor. The parameter $a_i$ is calculated in the LPC analyzer 2 and the LPC parameter/short term prediction parameter converter 5 for every frame and adaptively changes in response to a change in the spectrum of the input signal for every frame. The transfer function represented by expression (2) is incorporated also into the noise shaping filter 19 in the coder and the post noise shaping 45 in the decoder.

Generally, in order to keep the stability of the speech reproduction in the synthetic filters 24 and 43, a prediction obtained by the LPC analyzer 2 is intentionally reduced by introducing a coefficient, called a leakage. That is, generally the product of the leakage $r_s$ ($0<r_s<1$) and the short term prediction parameter is used as a filter parameter for the short term predictors or the noise shaping filters. Specifically, the transfer function $P_s(z)$ of the short term predictors 6, 24 and 43 is given by;

$$P_s(z) = \sum_{i=1}^{N_s} a_i r_s^i z^{-i} \quad (3)$$

where the leakage $r_s$ is fixed and the same value of the leakage $r_s$ is used on both the coder and decoder sides.

The same can be said on the other speech coding/decoding systems. As another example, the CELP system will be briefly described below.

On the transmitting side, firstly a correlation between adjacent samples is calculated from the digital input speech signal by LPC analysis and the short term prediction parameter is input to the synthetic filter. The synthetic filter is excited by a signal output from a vector-quantizer to obtain the reproduced speech signal. That is, the short term predicted signal is formed by the short term predictor and added to the exciting signal to reproduce the digital input speech signal in the synthetic filter. The reproduced speech signal is input to the short term predictor in order to form the short term predicted signal for the next timing. An error signal between the reproduced speech signal and the digital input speech signal is calculated and the exciting signal is so selected in order to minimize the power of the error signal audibly weighted by the weighting filter. Information on the exciting signal and a short term prediction is transmitted to the receiving side.

An exciting signal is formed from the information on the exciting signal by vector-quantizer. On the receiving side, the same as on the transmitting side, the reproduced speech signal is obtained by exciting the synthesis filter with the short term prediction parameter.

The short term predictors generally represented by expression (3) are included in the synthetic filters on the coder side and the decoder side. The leakages are fixed and the same value is used both the coder and decoder sides as described above.

As described above, a leakage as the one in expression (3) is generally used in the short term predictors 6, 24 and 43, the noise shaping filter 19 and the post noise shaping filter 44. The object of the leakage is to stabilize the operation of the short term predictors 24 and 43, the constituents of the synthetic filter. Conventionally, stability has been attained by intentionally reducing the prediction obtained by the LPC analyzer 2. Therefore, the use of small leakage reproduces the speech including a lot of quantization noise especially in the vicinity of a consonant or unvoiced sound. Conversely, the use of large leakage reproduces speech that appears to resonate especially in the vicinity of a vowel (voiced sound).

In the conventional system, however, the constant value leakage has been used irrespective of the nature of the speech. Therefore, the conventional speech coding/decoding system has had a problem that a sufficient decrease in the quantization noise is impossible and a good reproduced speech quality is unable to be obtained in both a voiced sound and an unvoiced sound.

SUMMARY OF THE INVENTION

It is an object, therefore, of the present invention to overcome the disadvantages and limitations of a prior speech signal coding/decoding system by providing a new and improved speech signal coding/decoding system.

It is also an object of the present invention to provide a speech signal coding/decoding system in which the quantization noise is decreased irrespective of a voiced sound and an unvoiced sound, and good speech quality is obtained.

The above and other objects are attained by a speech coding/decoding system comprising; a coding side including; a predictor (6,10) for providing a prediction signal of a digital input speech signal based upon a prediction parameter which is provided by a prediction parameter device (1,2,3,4;7,8,9) for outputting the prediction parameter, a quantizer (16) for quantizing a residual signal, the residual signal being obtained by subtracting the predicted signal and a shaped quantization noise from the digital input speech signal and a multiplexer (30) for multiplexing the output of the quantizer (16) as codes of the residual signal, and side information for sending to a receiver; a decoding side including; a demultiplexer (33) for separating the codes of the residual signal and the side information, an inverse quantizer (36) for inverse quantization and for decoding of a quantized residual signal from a transmitter side, a prediction parameter decoder (38) coupled with the output of the demultiplexer (33) for decoding a prediction parameter from a transmitter side, and a synthesis filter (42,43) for reproducing the digital input signal by adding an output of the inverse quantizer (36) and a reproduced predicted signal, wherein a device provides a coefficient of the synthesis filter (43) in a receiver side so that it differs from a coefficient of the predictor (6) in a transmitter side, wherein value of each coefficient is larger than 0 and smaller than 1.

According to another embodiment of the present invention, the system has a first leakage selector (47) provided in a coding side for adaptively adjusting a coefficient of the predictor (6) based upon the prediction parameter, and a second leakage selector (48) provided in a decoding side for adaptively adjusting a coefficient of the synthesis filter (43) based upon output of the prediction parameter decoder (38).

BRIEF DESCRIPTION OF THE DRAWINGS

The foregoing and other objects, features, and attendant advantages of the present invention will be appreciated as the same become better understood by means of the following description and accompanying drawings wherein.

DESCRIPTION OF THE PREFERRED EMBODIMENTS

A first feature of the present invention exists in a constitution wherein a leakage used in a transmitter side and/or a receiver side is adaptively adjusted in accordance with the accuracy of a prediction.

A second feature of the present invention is that different values are applied to the leakages used in a coder and a decoder to code or decode the digital input speech signal.

A third feature of the present invention is that the different leakages are used in the coder and the decoder and a gain difference generated by the different leakages is compensated.

Leakages used in a coder and a decoder and a gain adjustment relating to the leakages which make differences between the present invention and the prior art will be described in detail in a description below.

(Embodiment 1)

An embodiment 1 has a constitution wherein a leakage used in a transmitter side and/or a receiver side is adaptively adjusted in accordance with the accuracy of a prediction, that is, the leakage in a coder and/or the leakage in a decoder are adaptively changed.

Figure 2B:
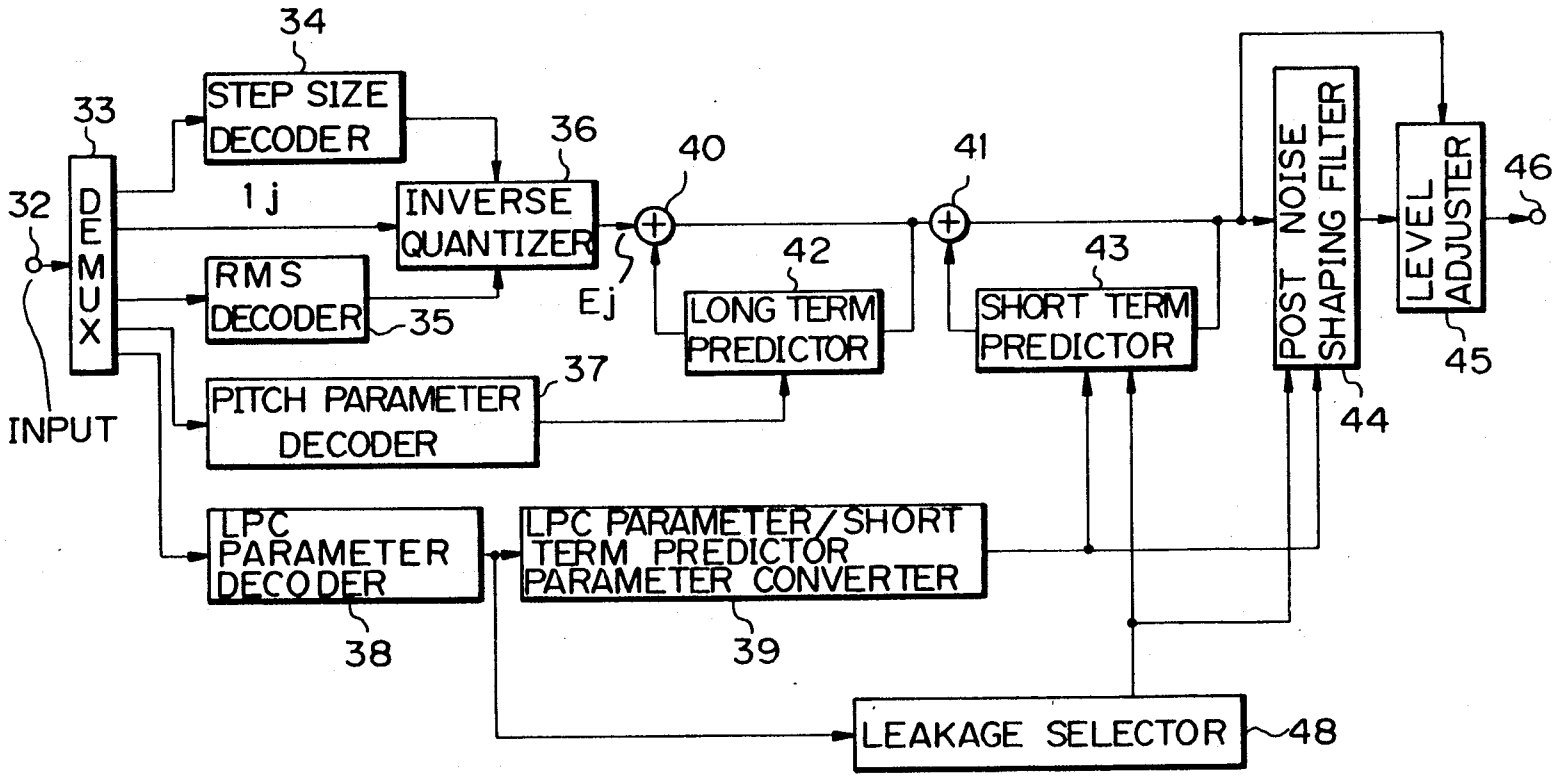

FIG. 2(*a*) shows the constitution of the coder for adaptively changing the leakage, which is a first embodiment according to the present invention.

A leakage selector 47 (first leakage means) adaptively selects the leakage which is the weighting factor of the predictor by evaluating the accuracy of a prediction by using an LPC parameter, the output of an LPC parameter decoder 4, to input the leakage to short term predictors 6 and 24 and a noise shaping filter 19. That is, a small leakage is used in the vicinity of a voiced sound wherein the prediction tends to be correct in order to prevent such a sound as a resonance from being generated and a large leakage is used in the vicinity of an unvoiced sound wherein the prediction tends not to be correct in order to reduce quantization noise. Thus, good reproduced speech is obtained by using the leakage with a suitable magnitude for the nature of the speech.

The embodiment according to the present invention is as follows: A kind of prediction accuracy (prediction gain) $G_p$ represented by $$G_p = \sum_{i=1}^{N_s} (1 - k_i^2) \tag{4}$$

is employed and the leakage $r_{sc}$ is changed over to $$r_{sc} = r_{s,1} \quad \text{when } G_p < G_{p,th1}, \tag{5}$$

and to $$r_{sc} = r_{s,2} \quad \text{when } G_p > G_{p,th1},$$

where $0 < G_{p,thl} < 1$ and $0 < r_{s,l} \leqq r_{s,2} < 1$.

The leakage value is input to the respective short term predictors 6 and 24 and the noise shaping filter 19. Besides changing the leakage at two steps as described above, the leakage can also be changed over three steps or more with finer thresholds. A reference $r_{s,1}$ designates the leakage of a portion wherein the prediction is correct, for example, the voiced sound and $r_{s,2}$ the leakage of a portion wherein the prediction is not correct, for example, the unvoiced sound.

FIG. 2(*b*) shows the circuit diagram of the decoder in the system according to the present invention. A leakage selector 48 adaptively selects the leakage which is the weighting factor of the synthesis filter by evaluating the prediction accuracy by using the LPC parameter, the output of the LPC decoder, to input the leakage to the short term predictor 43 and the post noise shaping filter 44. That is, the same as on a coder side, a small leakage is used in the vicinity of the voiced sound wherein the prediction tends to be correct in order to prevent such a sound as the resonance from being generated and a large leakage is used in the vicinity of the unvoiced sound wherein the prediction tends not to be correct in order to reduce the quantization noise. Thus, good reproduced speech can be obtained by using the leakage with a suitable magnitude for the nature of the speech.

An embodiment of the decoder side is as follows: One of the prediction accuracy given by an expression (4) is used. The leakage $r_{sd}$ is changed such that $$r_{sd} = r_{s,3} \quad \text{when } G_p < G_{p,th2}, \tag{6}$$

and $$r_{sd} = r_{s,4} \quad \text{when } G_p > G_{p,th2},$$

where $0<G_{p,th2}<1$ and $0<r_{s,3}\leqq r_{s,4}<1$.

The leakage value is input to the short term predictor 43 and the post noise shaping filter 44. Reference $r_{s,3}$ and $r_{s4}$ designate the leakages for the voiced sound and the unvoices sound, respectively.

Besides changing the leakage at two steps of the voiced sound and the unvoiced sound as described above, the leakage can be changed over at three steps or more by using the finer thresholds.

As described above, according to the present invention, the quantization noise can be reduced irrespective of the nature of the speech ; the voice sound or the unvoiced sound, by using the leakages on the coder and/or decoder sides in accordance with the prediction accuracy.

A first leakage selector and a second leakage selector may be implemented by a read only memory. Each address of that memory stores the leakage value depending upon the input signal which is used as an address selection signal of that memory. The input of the LPC parameter decoder 4 in FIG. 2(*a*), or the LPC parameter decoder 38 in FIG. 2(*b*) provide the amount indicating the accuracy of the prediction.

(Embodiment 2)

The second embodiment in which a leakage value in a decoder side differs from a leakage in a coder side is described next.

Figure 1A:
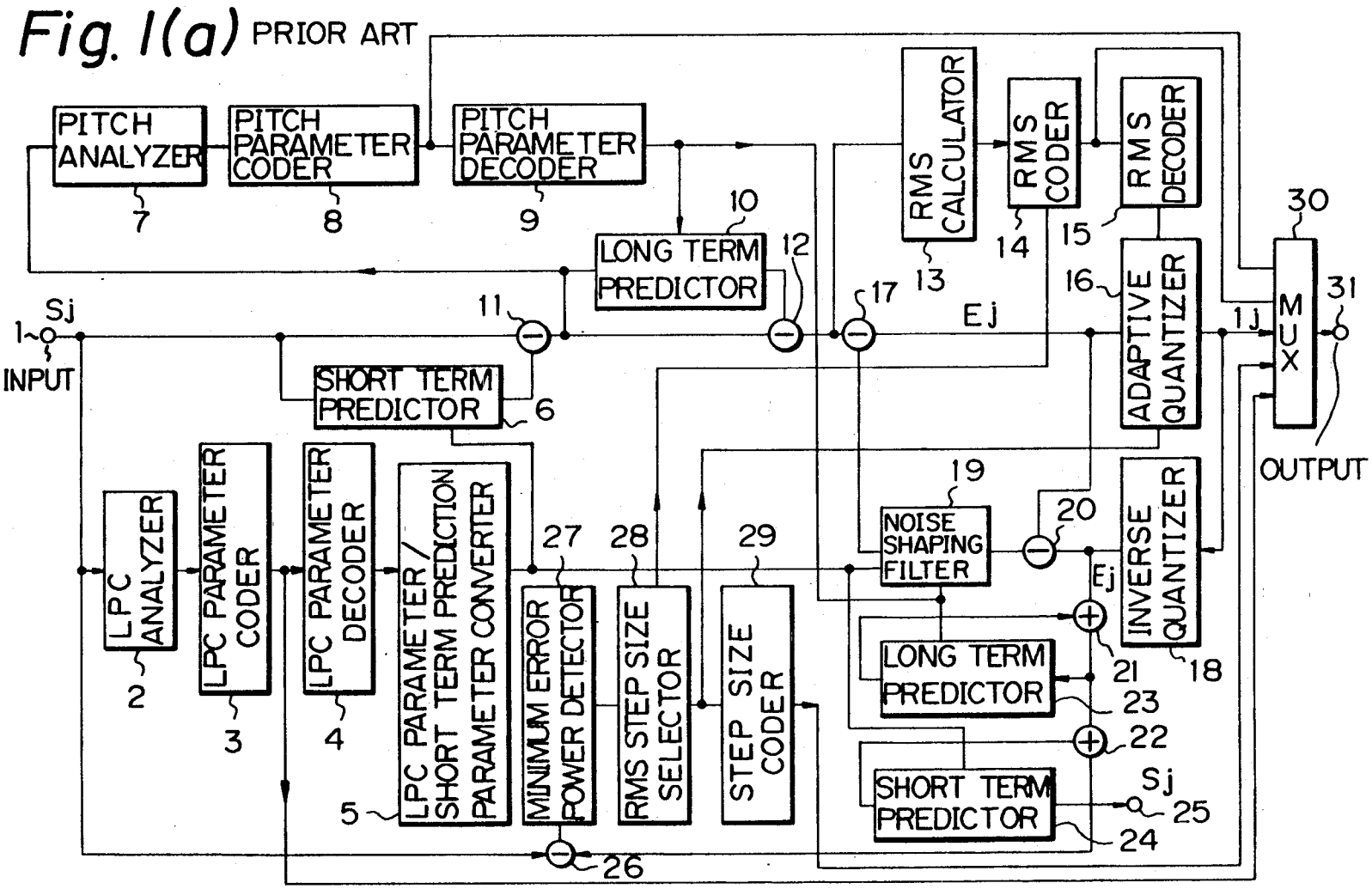
Fig. 1(a) PRIOR ART
FIGS. 1(*a*) and 1(*b*) are block diagrams of a coder and a decoder, respectively, of a prior speech signal coding/decoding system, FIG. 2(*a*) is a block diagram of a coder according to the present invention, FIG. 2(*b*) is a block diagram of a decoder according to the present invention.
Figure 1B:
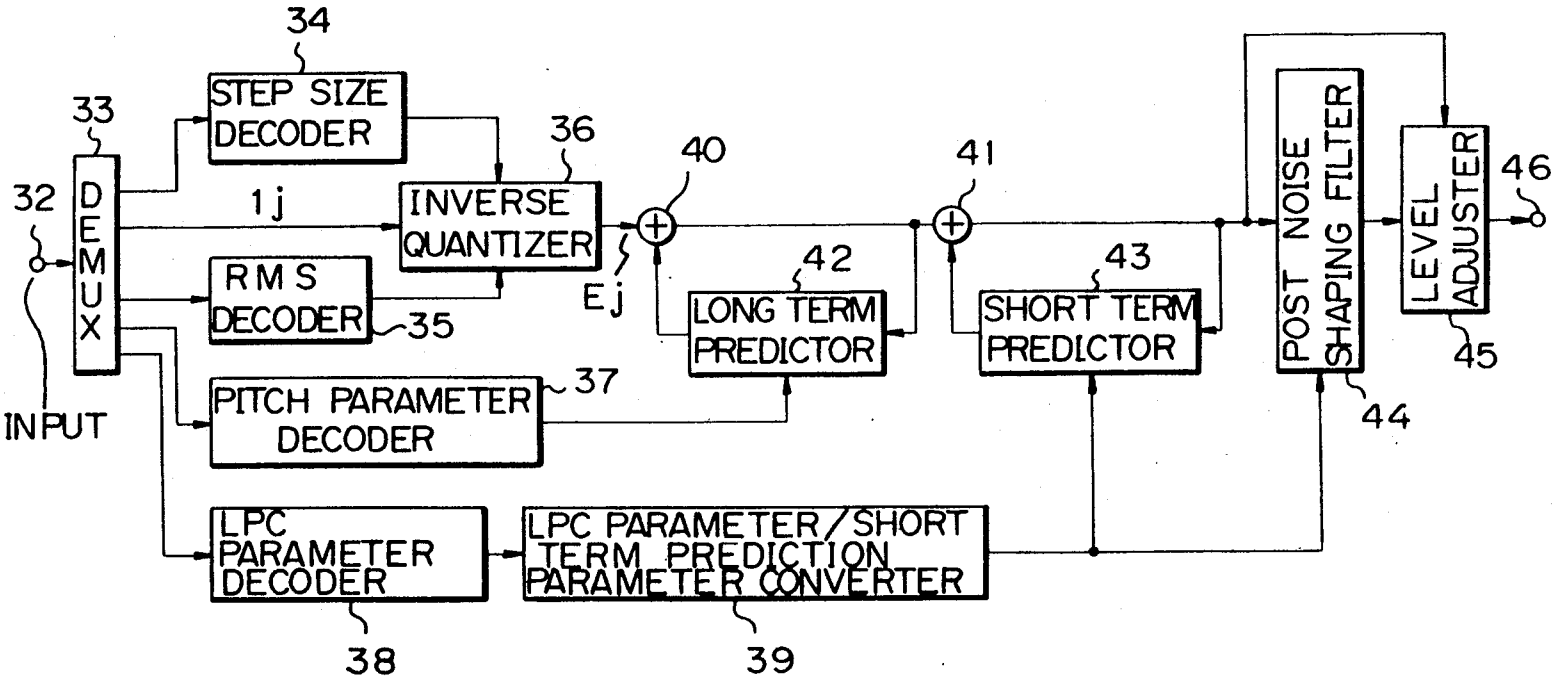
Fig. 1(b) PRIOR ART

As a second leakage means, the second feature of the present invention, a larger leakage than that used on the coder side is input to the short term predictor 43 and the post noise shaping filter 44. The structure of the coder and the decoder are the same as those shown in FIGS. 1(*a*) and 1(*b*), respectively. That is, the second leakage means equivalently improves the prediction accuracy of a short term prediction signal reproduced on the decoder side to reduce the quantization noise.

(Embodiment 3)

Figure 3:
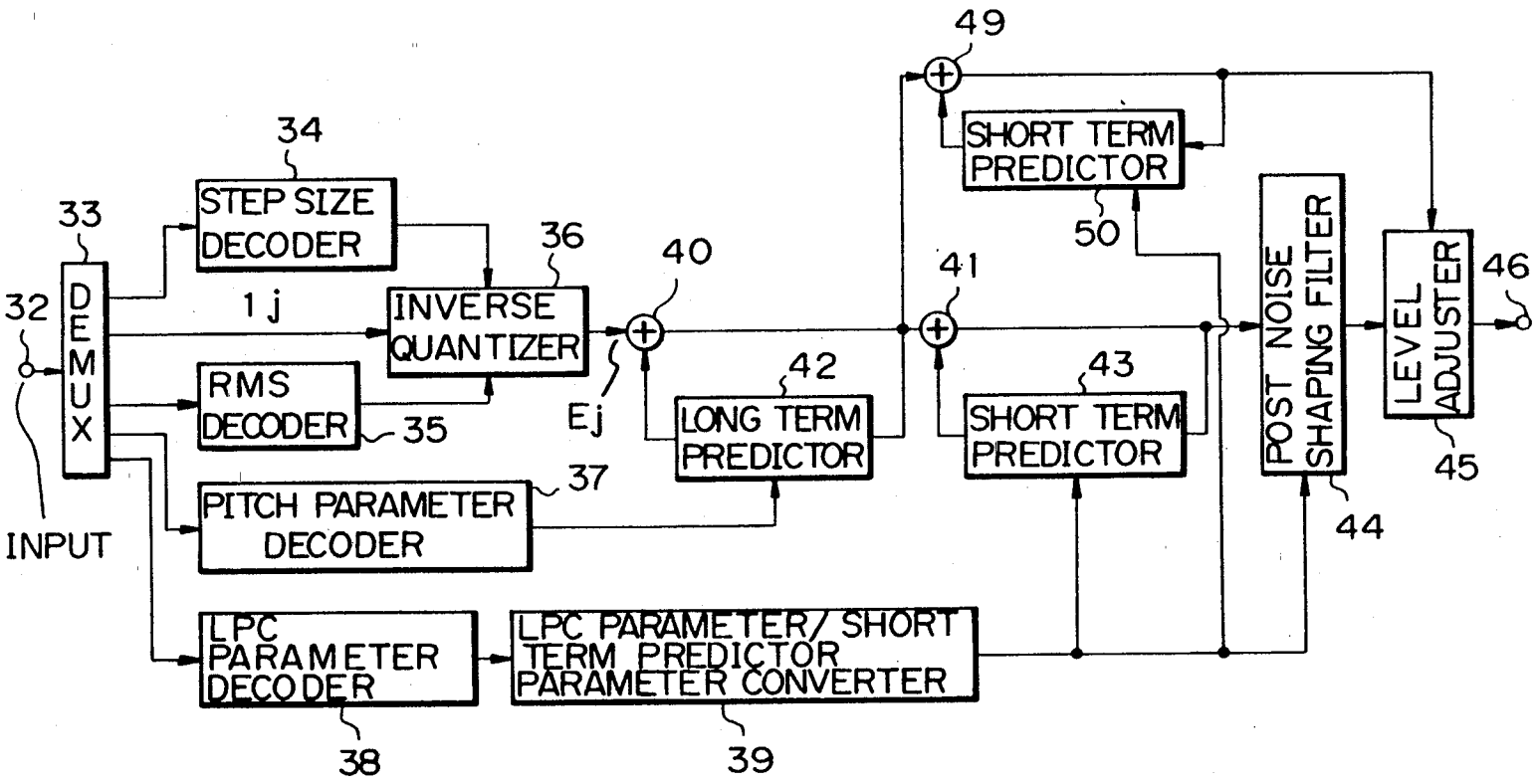
FIG. 3 is a block diagram of another embodiment of a decoder according to the present invention.

In the second embodiment, the reproduced speech signal is forced to have a gain due to a difference between the leakages. When the leakages on the coder and decoder sides are different from each other for the purpose of a reduction in the quantization noise, a difference between the gains of the voiced and unvoiced sound portions becomes too distinct due to a difference between the prediction accuracies, conversely resulting in the deterioration of the speech quality. Thus, in the structure of a third embodiment, the decoder is provided with a short term predictor 50 for compensating the gain as shown in FIG. 3.

The same as in the second embodiment, the leakage larger than that used on the coder side is input to the short term predictor 43. The same leakage as that used on the coder side is set to the gain adjusting short term predictor 50. Further, a short term prediction parameter, the output of the LPC parameter/short term prediction parameter converter 39, is input to the short term predictors 43, 50 and the post noise shaping filter 44. The output signal of the adder 40 is input to the adders 41 and 49 and the long term predictor 42. The adder 49 adds the output of the adder 40 and that of the short term predictor 50 to each other and a resultant is input to the predictor 50 and the level adjuster 45. The adder 41 adds the output of the short term predictor 43 and that of the adder 40 to each other and a resultant is input to the predictor 43 and the post noise shaping filter 44. The output signal of the adder 41 has a gain for the leakage used in the short term predictor 43 and further has an additional gain by passing the post noise shaping filter.

It should be noted that the short term predictor 43 has a leakage which differs from that of the coder side, and the short term predictor 50 has the same leakage as that of the coder side. Therefore, the level of the output of the short term predictor 43 is adjusted by using the output level of the short term predictor 50.

The gain is adjusted by the level adjuster 45. Specifically, a gain adjustment coefficient $G_0'$ is obtained by;

$$G_0' = \frac{\text{RMS value of output of adder 49}}{\text{RMS value of output of post noise shaping filter 44}} \tag{7}$$

from the output of the adder 49 and the output of the post noise shaping filter 44 to be multiplied by the output of the post noise shaping filter 44.

Thus, by providing the gain adjusting short term predictor 50, the leakages largely different from each other can be used on the coder and decoder sides as compared with the second embodiment, enabling the prediction accuracy to be improved on the decoder side. Therefore, the quantization noise can be resultingly reduced and the speech quality better than that in the second embodiment can be obtained.

(Embodiment 4)

A fourth embodiment has the constitution of the combination of above-described first and third embodiments. A change over is conducted according to the prediction accuracy and the leakage different from that on the coder side is used on the decoder side.

Figure 4:
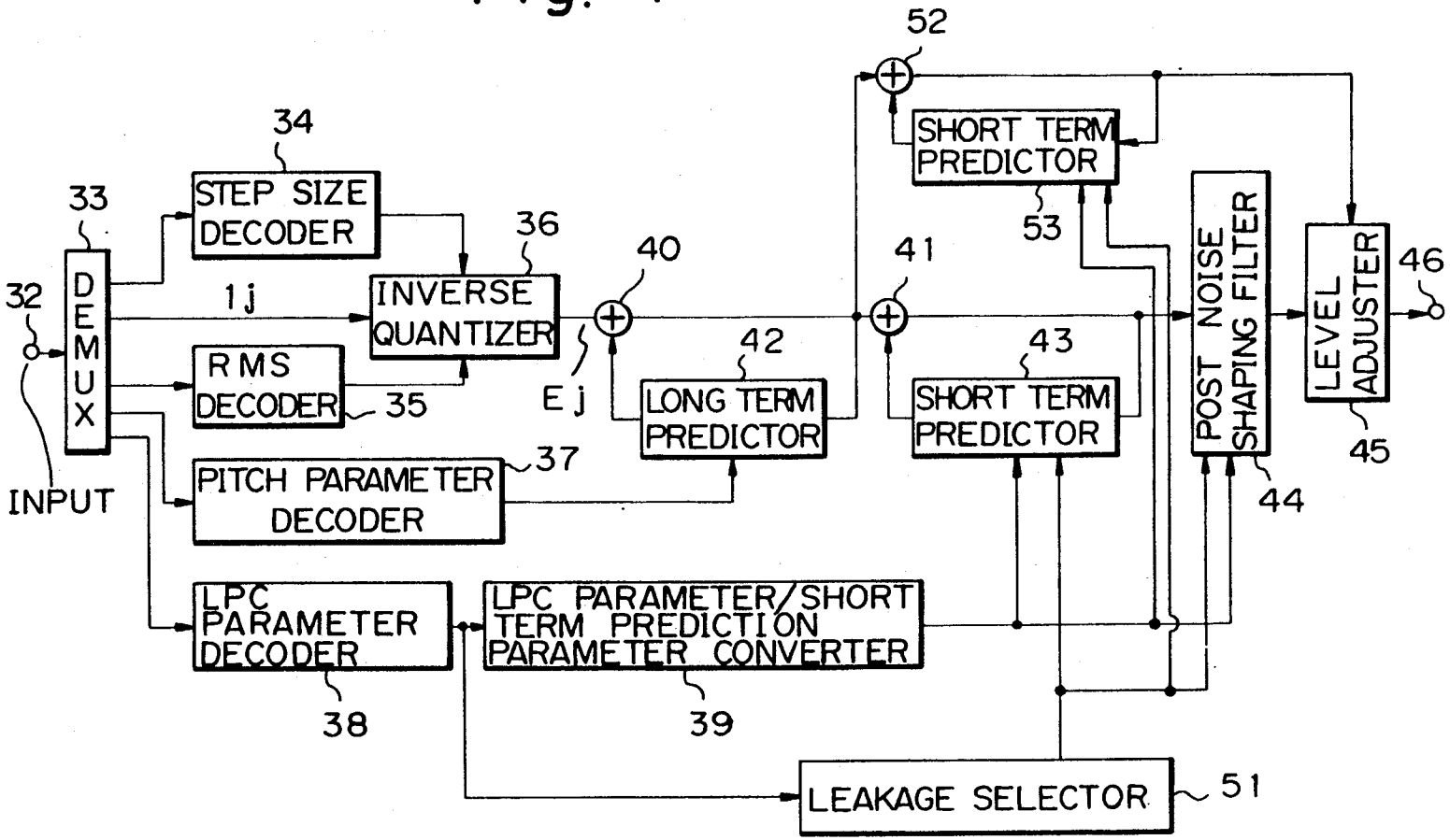
FIG. 4 is a block diagram of a decoder of still another embodiment according to the present invention.

FIG. 4 shows the constitution of the decoder, a fourth embodiment according to the present invention.

A leakage selector 51 adaptively selects and inputs the leakage for the short term predictor 43, a constituent of the synthetic filter, by evaluating the prediction accuracy by using the LPC parameter, the output of the LPC parameter decoder 38. The same leakage as that on the coder side is input to a gain adjusting short term predictor 53. The output of the adder 40 is input to the long term predictor 42 and the adders 41 and 52. The adder 52 adds the output of the short term predictor 53 and that of the adder 40 to each other and a resultant is input to the short term predictor 53 and the level adjuster 45. The embodiment 4 is exemplified as follows: When the prediction accuracy is defined by expression (4) and the leakage on the coder side is $r_{sc}$, the leakage $r_{sd}$ on the decoder side is changed over so as to satisfy the following expression:

$$r_{sd} = r_{sd,1} \quad \text{when } G_p < G_{p,th1} \tag{8}$$

and $$r_{sd} = r_{sd,2} \quad \text{when } G_p > G_{p,th1},$$

where $0<G_{p,th1}<1$ and $0<r_{sc}<r_{sd,1}<r_{sd,2}<1$.

The gain adjustment coefficient $G_0$ is given by $$G_0 = \frac{\text{RMS value of output of adder 52}}{\text{RMS value of output of post noise shaping filter 44}} \quad (9)$$

In the fourth embodiment, the quantization noise in the whole speech can be reduced by equivalently improving the prediction accuracy of the reproduced short term predicted signal by using the leakage with a larger value on the decoder side than that on the coder side. The quantization noise can be further decreased using the larger leakage in the vicinity of the unvoiced sound wherein the quantization noise tend to be generated than that in the vicinity of the voiced sound. Thus, the reproduced speech quality which is better than that of above-described embodiments can be obtained in the fourth embodiment.

As a numerical example, the leakages used in a device with a 9.6 kbps adaptive predictive coding system with maximum likelihood quantization (APC-MLQ) will be mentioned below.

o leakage on coder side $r_{sc} = 0.9375$ o leakage on decoder side $r_{sd} = 0.963$ when $G_p < G_{p,th1}$, and $r_{sd} = 0.973$ when $G_p > G_{p,th1}$.

While adaptive predictive coding system with the maximum likelihood quantization (APC-MLQ) is exemplified in a description above, the same effect can be obtained by applying the present invention to the other MPEC system, CELP system or the like.

As described above, a constitution wherein a coder and a decoder are provided with leakages and the provision of at least one of two leakage means; first leakage means for adaptively changing the leakages in accordance with the prediction accuracy of a predictive signal and second leakage means for allotting the different leakages determined in advance to a coder side and a decoder side, enable quantization noise to be reduced irrespective of a voiced sound or an unvoiced sound and enable a good reproduced speech quality to be obtained according to the present invention.

Since largely different leakages from each other can be used on the coder side and the decoder side by providing the second leakage means with a gain adjusting means for adjusting the gains of the decoder, the speech quality can be further improved on the decoder side.

The provision of the gain adjusting means in addition to the first and second leakage means enables the quantization noise to be further reduced irrespective of the voiced sound or the unvoiced sound, and enables good reproduced speech quality to be obtained.

The use of the LPC parameter for forming the predicted signal enables excellent prediction accuracy thereof to be realized by the simple constitution without requiring a new circuit.

Therefore, a highly efficient speech coding/decoding system at a low bit rate can be obtained according to the present invention and its effect is extremely large.

From the foregoing it will now be apparent that a new and improved speech signal coding/decoding system has been found. It should be understood of course that the embodiments disclosed are merely illustrative and are not intended to limit the scope of the invention. Reference should be made to the appended claims, therefore, rather than the specification as indicating the scope of the invention.

What is claimed is:

1. A speech coding/decoding system comprising:

a coding side including a predictor providing a predicted signal of a digital input speech signal based upon a) a prediction parameter which is output by a prediction parameter means and b) a first leakage coefficient, a quantizer quantizing a residual signal input thereto, said residual signal is a function of said digital input speech signal and said predicted signal, a multiplexer multiplexing an output of said quantizer as coded signals of the residual signal, and multiplexing said prediction parameter and multiplexing other information for sending to a decoding side;

said decoding side including a demultiplexer separating said coded signals of said residual signal, said prediction parameter and the other information from said coding side, an inverse quantizer for inverse quantization and decoding of said coded signals of said residual signal from said demultiplexer, a prediction parameter decoder, coupled with an output of said demultiplexer, decoding said prediction parameter from said coding side, a synthesis filter reproducing said digital input signal by adding an output of said inverse quantizer and a reproduced predicted signal, said reproduced prediction signal based upon a) said decoded prediction parameter and b) a second leakage coefficient, and means for providing said second leakage coefficient of said synthesis filter in said decoding side so that said second leakage coefficient differs from said first leakage coefficient of said predictor in said coding side, wherein a value of each respective leakage coefficient is larger than 0 and smaller than 1.

2. A speech coding/decoding system comprising:

a coding side including a predictor having a first leakage coefficient, said predictor providing a predicted signal of a digital input speech signal based upon a) a prediction parameter which is output by a prediction parameter means and b) a first leakage coefficient, a quantizer quantizing a residual signal input thereto, said residual signal is a function of said digital input speech signal and said predicted signal, a multiplexer multiplexing an output of said quantizer as coded signals of said residual signal, and multiplexing said prediction parameter and information for sending to a decoding side;

said decoding side including a demultiplexer separating said coded signals of said residual signal, said prediction parameter and the information from said coding side, an inverse quantizer for inverse quantization and decoding of said coded signals of said residual signal from said demultiplexer, a prediction parameter decoder, coupled with an output of said demultiplexer, decoding said prediction parameter from said coding side, a synthesis filter reproducing said digital input signal by adding an output of said inverse quantizer and a reproduced predicted signal, said reproduced prediction signal based upon a) said decoded prediction parameter and b) a second leakage coefficient, a first leakage selector is provided in said coding side for adaptively adjusting said first leakage coefficient of said predictor based upon said prediction parameter, and a second leakage selector is provided in said decoding side for adaptively adjusting said second leakage coefficient of said synthesis filter based upon an output of said prediction parameter decoder, a value of said first leakage coefficient of said first leakage selector and said second leakage coefficient of said second leakage selector is larger than 0 and smaller than 1, depending upon a prediction gain which is output by said prediction parameter means.

3. A speech coding/decoding system according to claim 2, wherein said value of said second leakage coefficient of said second leakage selector on said decoding side is larger than said value of said first leakage coefficient of said first leakage selector on said coding side.

4. A speech coding/decoding system according to claim 1, wherein a level adjuster is provided on said decoding side, and said level adjuster compensates a gain difference between said coding side and said decoding side because of a difference between values of said respective leakage coefficients.

5. A speech coding/decoding system according to claim 2, wherein each of said respective values is switched between two values depending upon an accuracy of a prediction by the predictor.

6. A speech coding/decoding system according to claim 2, wherein said value of said first leakage coefficient on said coding side is 0.9375, and said value of said second leakage coefficient on said decoding side is 0.963 when the prediction gain is smaller than a predetermined value and said value of said second leakage coefficient is 0.973 when said prediction gain is larger than said predetermined value.

7. A speech coding/decoding system according to claim 2, wherein each of said values of said first and second leakage coefficients is selected among more than three values.

8. A speech coding/decoding system according to claim 2, wherein each of said first leakage selector and said second leakage selector is implemented by a read only memory.

9. A speech coding/decoding system comprising:

a predictor providing a predicted signal of a digital input speech signal, to output a residual signal, by removing correlations from said digital input speech signal, a quantizer quantizing said residual signal for sending to a receiver, wherein a leakage selector is provided for adaptively adjusting a leakage, which is a weighting factor of said predictor, depending upon a prediction gain which indicates an accuracy of prediction.

10. A speech coding/decoding system comprising:

an inverse quantizer reproducing a quantized residual signal from a coded residual signal from a coding side, a synthesis filter reproducing a digital input signal from said quantized residual signal, wherein a leakage selector is provided for adaptively adjusting a leakage, which is a weighting factor of said synthesis filter, depending upon a prediction gain which indicates an accuracy of prediction.

11. A speech coding/decoding system comprising:

a coding side including a predictor providing a predicted signal of a digital input speech signal, to output a residual signal, by removing correlations from said digital input speech signal, and a quantizer quantizing said residual signal for sending to a decoding side, said decoding side including an inverse quantizer reproducing a quantized residual signal from a coded residual signal input from said coding side, and a synthesis filter reproducing said digital input signal from said quantized residual signal, wherein a weighting factor of said synthesis filter in said decoding side is different from a weighting factor of said predictor in said coding side, wherein a value of each respective weighting factor is larger than 0 and smaller than 1.

12. A speech coding/decoding system according to claim 11, wherein the value of the weighting factor of said synthesis filter is larger than the value of the weighting factor of said predictor.

13. A speech coding/decoding system according to claim 11, wherein a level adjuster is provided on said decoding side, and said level adjuster compensates for a gain difference between said coding side and said decoding side because of a difference in values of the weighting factors between said coding and decoding sides.

* * * * *